US007802559B2

(12) United States Patent
Fürst et al.

(10) Patent No.: US 7,802,559 B2
(45) Date of Patent: Sep. 28, 2010

(54) HOLD-DOWN DEVICE FOR A FUEL INJECTION DEVICE, AND FUEL INJECTION DEVICE

(75) Inventors: Thomas Fürst, Schieberdingen (DE); Thilo Bolz, Kraichtal (DE)

(73) Assignee: Robert Bosch GmbH, Stuttgart (DE)

( * ) Notice: Subject to any disclaimer, the term of this patent is extended or adjusted under 35 U.S.C. 154(b) by 150 days.

(21) Appl. No.: 11/664,354

(22) PCT Filed: Sep. 20, 2005

(86) PCT No.: PCT/EP2005/054693

§ 371 (c)(1),
(2), (4) Date: Sep. 26, 2008

(87) PCT Pub. No.: WO2006/037726

PCT Pub. Date: Apr. 13, 2006

(65) Prior Publication Data

US 2009/0056674 A1 Mar. 5, 2009

(30) Foreign Application Priority Data

Oct. 1, 2004 (DE) ..... 10 2004 048 401

(51) Int. Cl.
*F02M 61/14* (2006.01)

(52) U.S. Cl. ..... 123/470

(58) Field of Classification Search ..... 123/470
See application file for complete search history.

(56) References Cited

U.S. PATENT DOCUMENTS 4,993,390 A * 2/1991 Ono et al. ..... 123/470
5,074,269 A * 12/1991 Herbon et al. ..... 123/470
5,167,213 A * 12/1992 Bassler et al. ..... 123/470
5,501,195 A * 3/1996 Hall ..... 123/470
5,803,052 A * 9/1998 Lorraine et al. ..... 123/470
5,893,351 A * 4/1999 Akutagawa et al. ..... 123/470
5,909,725 A * 6/1999 Balsdon et al. ..... 123/516
5,970,953 A * 10/1999 Lorraine et al. ..... 123/470
6,053,149 A * 4/2000 Lorraine ..... 123/470
6,276,339 B1 * 8/2001 Shebert et al. ..... 123/470
6,457,456 B1 10/2002 Scollard et al.
6,637,411 B2 * 10/2003 Makiyama ..... 123/470
6,668,803 B1 * 12/2003 McClean et al. ..... 123/470

(Continued)

FOREIGN PATENT DOCUMENTS

DE 29 26 490 2/1981

(Continued)

*Primary Examiner*—Thomas N Moulis
(74) *Attorney, Agent, or Firm*—Kenyon & Kenyon LLP

(57) ABSTRACT

The hold-down device for a fuel injection device is distinguished by a particularly simple design that nonetheless permits a very effective holding down of a fuel injection valve. The fuel injection device includes at least one fuel injection valve, a receptacle bore for the fuel injection valve, and a connecting fitting of a fuel distributor line, the hold-down device being clamped between a shoulder of the fuel injection valve and an end surface of the connecting fitting. The hold-down device has a partially annular base element from which there extends, in a bent-away fashion, an axially flexible hold-down clip that has at least two webs, two oblique segments, and two support segments. The fuel injection valve is particularly suitable for use in fuel injection systems of mixture-compressing externally ignited internal combustion engines.

20 Claims, 4 Drawing Sheets

U.S. PATENT DOCUMENTS

| | | | | |
|---|---|---|---|---|
| 6,705,292 | B2 * | 3/2004 | Bugos | 123/470 |
| 6,830,037 | B1 * | 12/2004 | Braun et al. | 123/470 |
| 7,373,926 | B2 * | 5/2008 | Eckbauer et al. | 123/470 |
| 7,406,946 | B1 * | 8/2008 | Watanabe et al. | 123/470 |
| 2005/0161025 | A1 * | 7/2005 | Braun et al. | 123/470 |

FOREIGN PATENT DOCUMENTS

| | | |
|---|---|---|
| DE | 19953269 | 6/2001 |
| DE | 100 12 759 | 9/2001 |
| DE | 101 08 193 | 8/2002 |
| DE | 101 51 004 | 6/2003 |
| DE | 101 52 421 | 6/2003 |
| DE | 101 63 030 | 7/2003 |
| EP | 0915253 | 5/1999 |
| EP | 1544 455 | 7/2005 |
| FR | 2776025 | 9/1999 |
| JP | 9100758 | 4/1997 |
| JP | 2000018127 | 1/2000 |
| WO | WO 2005/083262 | 9/2005 |

* cited by examiner

HOLD-DOWN DEVICE FOR A FUEL INJECTION DEVICE, AND FUEL INJECTION DEVICE

FIELD OF THE INVENTION

The present invention is based on a hold-down device for a fuel injection device, as well as to a fuel injection device.

BACKGROUND INFORMATION

From German Patent Publication No. 29 26 490, a fastening device is known for fastening a fuel injection valve to an intake pipe, in which the axial fixing of the fuel injection valve to the fuel distributor line, or to a plug nipple, takes place via a fastening element constructed as a U-shaped securing bracket having two limbs that are flexible in the radial direction. In the assembled state, the securing bracket engages through corresponding openings in the plug nipple, and is capable of snapping into an opening, fashioned as an annular groove, in a connecting fitting of the fuel injection valve. The axial play between the openings and the securing bracket, as well as between the annular groove and the securing bracket, should be kept small in order to achieve a precise fixing of the fuel injection valve without twisting the seal.

A disadvantage of the fastening device known from German Patent Publication No. 29 26 490 is in particular the twisting effect that the various holding parts have on the fuel injection valve. The flow of force that is produced in the fuel injection valve results in deformations, and thus in changes in the stroke of the valve needle, up to the point of jamming, and to a pressure or bending load on the housing parts, which in general have thin walls and are welded to one another at various points. In addition, each fastening measure, using for example a bearing collar, results in an enlargement of the radial extension of the fuel injection valve, and thus to an increased space requirement during installation.

From German Patent Publication No. 101 08 193, a fastening device is already known for the mutual fastening of a fuel injection valve in a cylinder head of an internal combustion engine, and of the fuel injection valve to a fuel distributor line. The fastening device has a sleeve that is clamped between a shoulder of the fuel distributor line and a shoulder of the fuel injection valve and is made of an elastic material. Due to its tubular structure, the sleeve can transmit the hold-down forces to the fuel injection valve with only limited effectiveness. The surfaces, loaded by the shoulders of the fuel injection valve and the fuel distributor line, of the sleeve that acts as the hold-down device are formed by the cut edges that result from the process of manufacturing the sleeve blank.

SUMMARY OF THE INVENTION

The hold-down device according to the present invention for a fuel injection device has the advantage that it has a particularly simple construction, is very easy and economical to manufacture, and nonetheless achieves a very effective holding down of a fuel injection valve in a receptacle bore of a cylinder head or of an intake pipe. Using conventional manufacturing methods, such as stamping, eroding, or laser cutting, blanks for the eventual hold-down device can be detached from sheets of spring steel or high-grade steel, and can be brought into numerous fairly complex desired shapes through bending.

With the hold-down device according to the present invention, which does not have rotational fixing means, a more precise orientation of the fuel injection valve is possible in relation to known hold-down devices having integrated rotational fixing elements, because the component tolerances of the hold-down device for the rotational fixing are omitted as a result of the design according to the present invention. In addition, the hold-down device can compensate greater axial tolerances than is possible with known hold-down devices. The above-indicated advantages result above all in connection with the fuel injection device indicated in claim 14, which has a simple rotational fixing.

It is advantageous to realize the hold-down device as a stamped bent part, and to shape it and to install it in a fuel injection device in such a way that the surfaces of the oblique segments and support segments of the hold-down device that are loaded by bending tension run perpendicular to the cut edges that result when the blank for the hold-down device is detached from the corresponding sheet. In this way, the long-term loading capacity of the segments, loaded to the point of bending, of the hold-down clip of the hold-down device can be increased, and an optimal hold-down force, exerted on the fuel injection valve so as to fix it securely in the receptacle bore, can be achieved.

The fuel injection device according to the present invention, has the advantage that, through simple measures at the fuel injection valve and at the connecting fitting, a direct and therefore very precise rotational fixing is created between the fuel injection valve and the connecting fitting. For this purpose, on the fuel injection valve a pin-shaped raised cog is provided that corresponds to a groove-type recess or opening on the connecting fitting of the fuel distributor line. The cog, extending into the opening, of the fuel injection valve provides, independent of the hold-down device, a rotational securing of the fuel injection valve in relation to the fuel distributor line, and provides a secure allocation of the rotational position of the hold-down device to the fuel injection valve.

It is particularly advantageous to provide the hold-down device, seen in the peripheral direction, with an open area in such a way that the connecting plug of the fuel injection valve protrudes through this area so that an unambiguous installation position for the hold-down device is defined. A rotational fixing of the hold-down device in relation to the connecting fitting is omitted, due to the pairing cog/opening at the fuel injection valve/connecting fitting. Here, the hold-down device is assembled to the fuel injection valve in such a way that a hold-down clip, loaded by bending tension, is oriented away from the connecting plug of the fuel injection valve.

BRIEF DESCRIPTION OF THE DRAWINGS

Exemplary embodiments of the present invention are shown in simplified fashion in the drawing and are explained in more detail in the following description.

DETAILED DESCRIPTION

Figure 1:
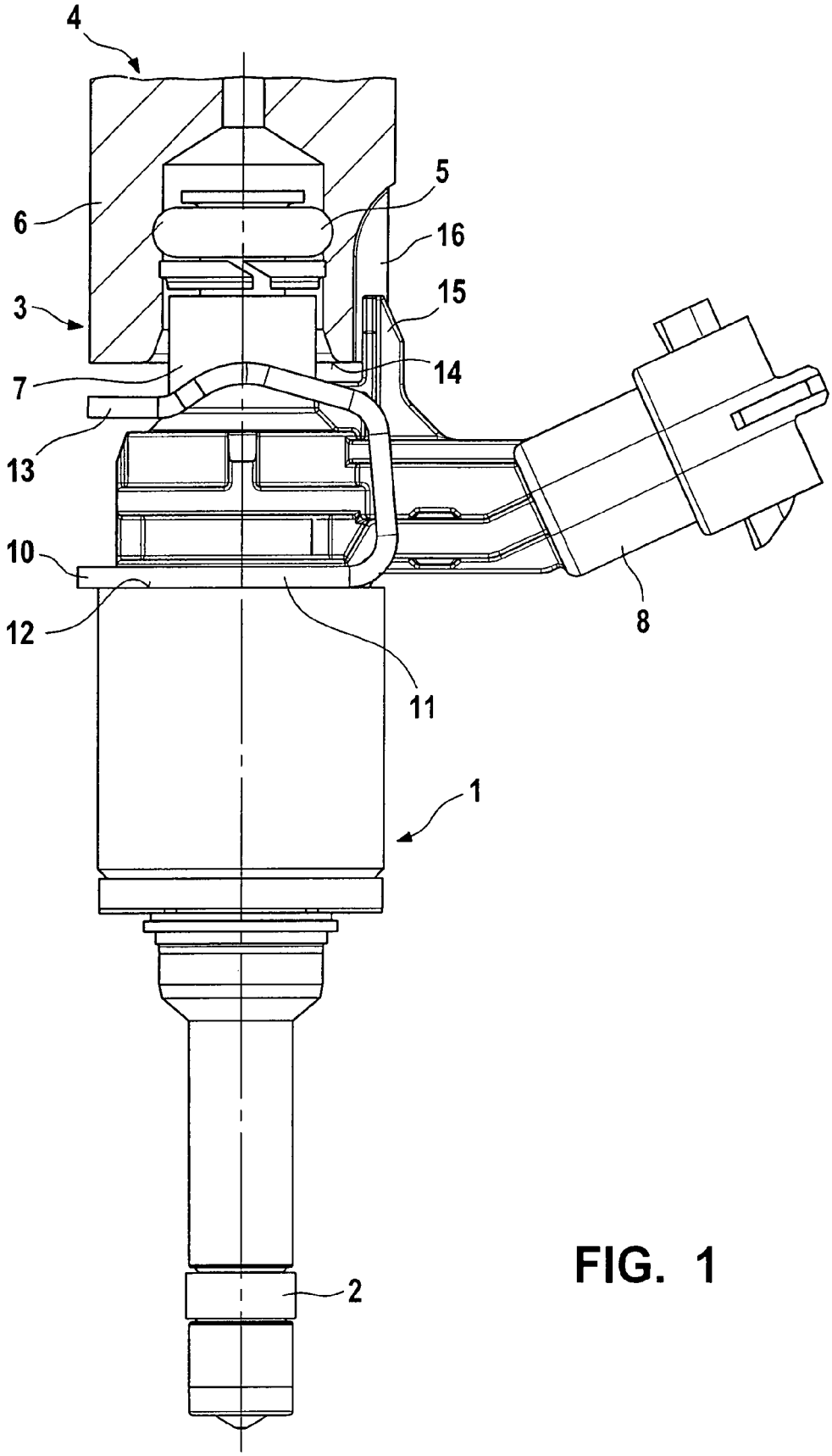
FIG. 1 shows a partial representation, in a side view, of a fuel injection device having a first hold-down device.

In FIG. 1, as an exemplary embodiment a valve is shown in the form of an injection valve 1 for fuel injection systems of mixture-compressing externally ignited internal combustion engines, in a side view. Fuel injection valve 1 is part of a fuel injection device. With a downstream end, fuel injection valve 1, realized in the form of a direct-injecting injection valve for the direct injection of fuel into a combustion chamber of the internal combustion engine, is installed in a receptacle bore of a cylinder head (not shown). A sealing ring 2, made in particular of Teflon, provides an optimal sealing of fuel injection valve 1 in relation to the wall of the cylinder head. The valve receptacle can likewise be provided on a receptacle fitting of an intake pipe (not shown).

On its end 3 at the inflow side, fuel injection valve 1 has a plug connection to a fuel distributor line 4, sealed by a sealing ring 5 between a connecting fitting 6 of fuel distributor line 4, shown in section, and an inflow fitting 7 of fuel injection valve 1. Fuel injection valve 1 has an electrical connecting plug 8 for the electrical contacting for the actuation of fuel injection valve 1.

In order to hold fuel injection valve 1 and fuel distributor line 4 at a distance from one another without radial forces, and to hold fuel injection valve 1 down securely in the receptacle bore of the cylinder head or intake pipe, according to the present invention a hold-down device 10 is provided between fuel injection valve 1 and connecting fitting 6. Hold-down device 10 is realized as a clip-type component; e.g., a stamped bent part. Hold-down device 10 has a partially annular base element 11, which does not have an extension of 360° but rather has an extension of only about 250° to 320°, and is supported on a shoulder 12 of fuel injection valve 1. With a hold-down clip 13 that is bent away from flat base element 11 and is axially resilient, hold-down device 10, in its assembled state, lies against a downstream end surface 14 of connecting fitting 6 on fuel distributor line 4. In the area of electrical connecting plug 8, hold-down device 10 is interrupted, this device forming in itself a closed clip element, as is illustrated in particular in FIGS. 2 to 4. In this way, hold-down device 10 can surround fuel injection valve 1, while nonetheless enabling electrical connecting plug 8 to protrude through. The resilient clips of hold-down clip 13 extend away from connecting plug 8.

In the area of transition from electrical connecting plug 8 to the plastic mold at least partly surrounding fuel injection valve 1 in the area of inflow fitting 7, on fuel injection valve 1 a pin-shaped raised cog 15 is provided that corresponds to a groove-type recess or opening 16 on connecting fitting 6 of fuel distributor line 4. Cog 15, extending into opening 16, of fuel injection valve 1 provides a direct and therefore very secure rotational securing of fuel injection valve 1 in relation to fuel distributor line 4, and for a reliable allocation of the rotational position of hold-down device 10 to fuel injection valve 1. On the other hand, hold-down device 10 according to the present invention makes possible a more precise orientation of fuel injection valve 1 in comparison with known hold-down devices having integrated rotational fixing devices, because the component tolerances of hold-down device 10 for the rotational fixing are not present, as a result of the design according to the present invention. In addition, hold-down device 10 can compensate greater axial tolerances than is possible with known hold-down devices.

Figure 2:
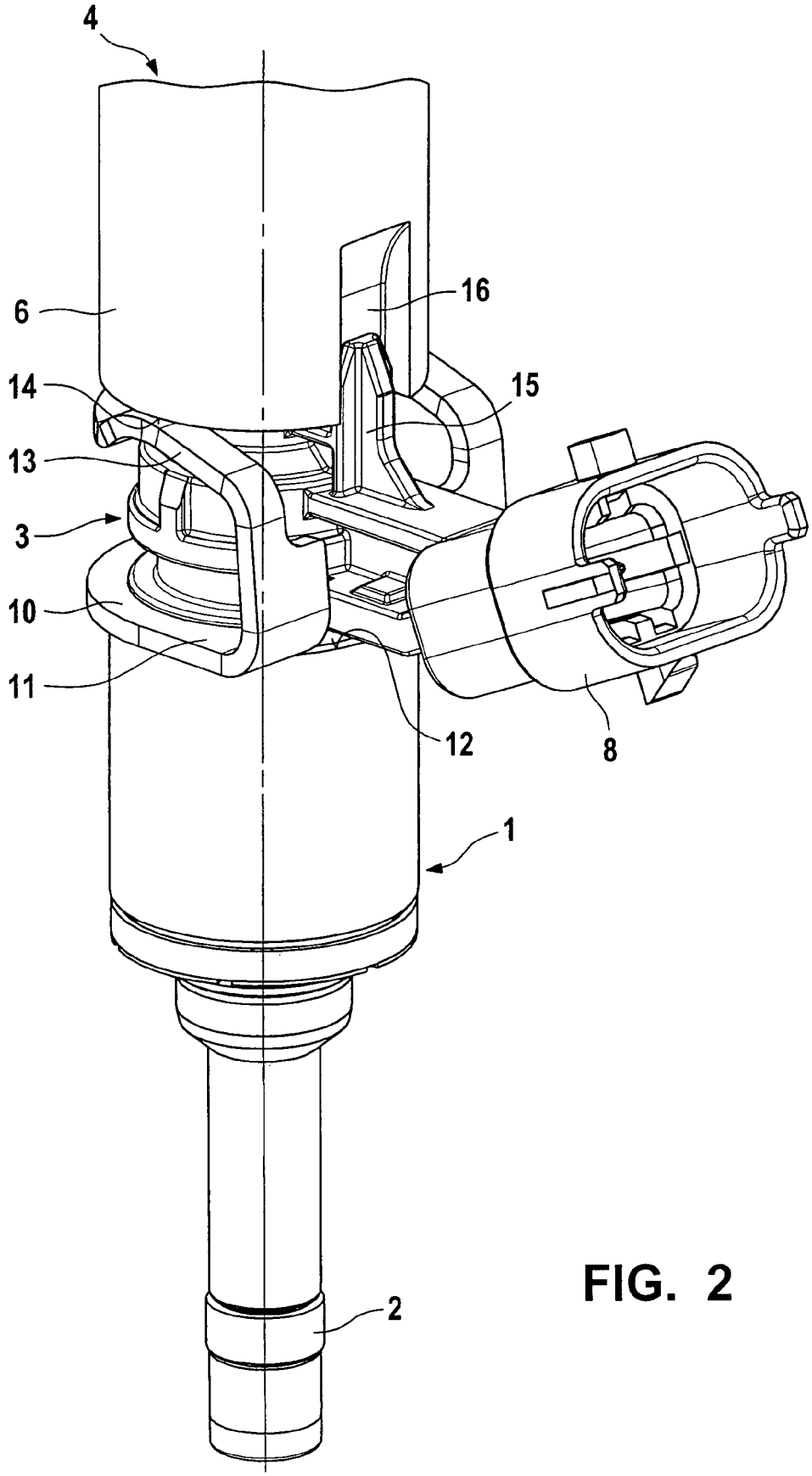
FIG. 2 shows the fuel injection device according to FIG. 1 in a perspective view.

Opening 16 on connecting fitting 6 of fuel distributor line 4 goes out from end surface 14 and runs in the manner of a slot or groove in the axial direction. Opening 16, which is made for example by machining, here has an axial extension such that cog 15 of fuel injection valve 1 can be accommodated in its complete length. In FIG. 2, the fuel injection device according to FIG. 1 is shown in a perspective view. This representation illustrates in particular the installation position of hold-down device 10 between shoulder 12 and end surface 14, as well as the engagement of cog 15 in opening 16.

Figure 3:
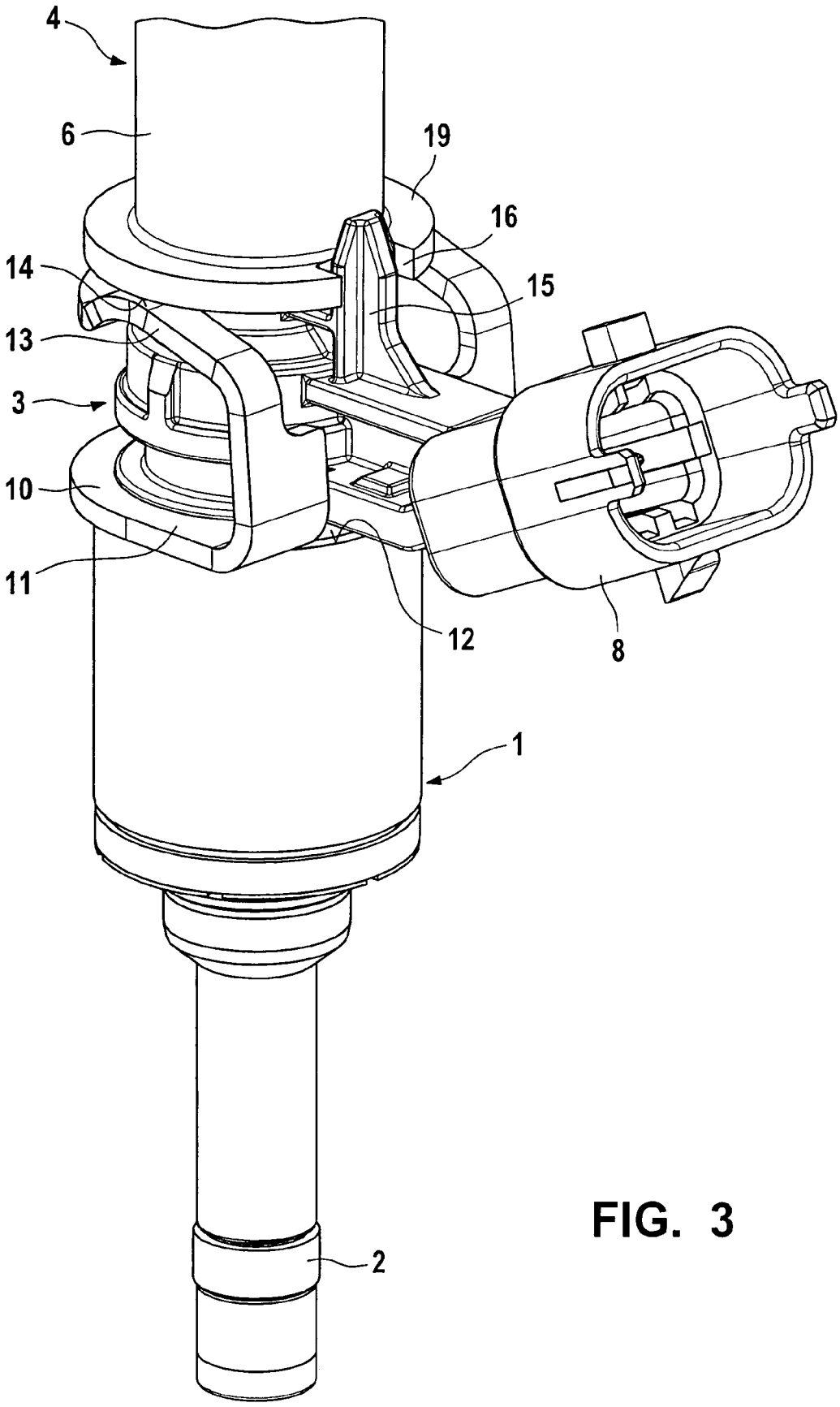
FIG. 3 shows a second exemplary embodiment of a fuel injection device in a perspective view.

The second exemplary embodiment of a fuel injection device, shown in FIG. 3 in a perspective view, differs from the exemplary embodiment shown in FIG. 2 above all in the construction of connecting fitting 6, as well as of opening 16. Connecting fitting 6 of fuel distributor line 4 has, at its downstream end, a collar 19 that stands out in annular fashion, on which end surface 14 is fashioned for the seating of hold-down device 10 with its hold-down clip 13, and in which opening 16 is formed. Here, in the installed state of fuel injection valve 1, groove-type opening 16 is fully penetrated by cog 15. In connecting fitting 6, which is for example deep-drawn, opening 16 is made by stamping or by machining.

Figure 4:
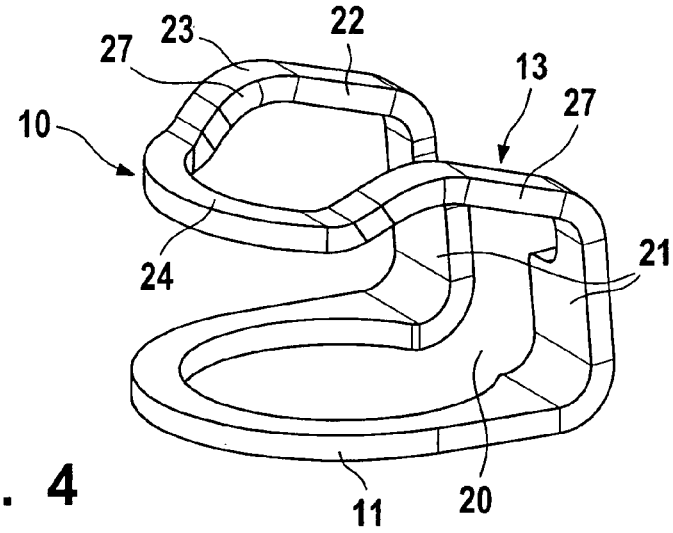
FIG. 4 shows the hold-down device used in the fuel injection devices of FIGS. 1 to 3 as an individual component.
Figure 5:
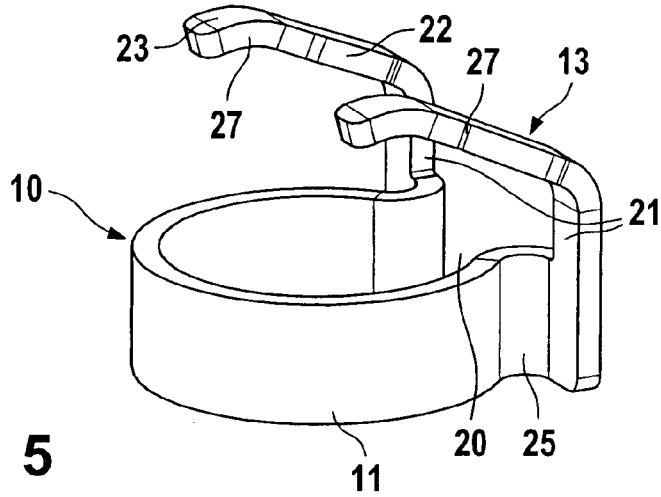
FIG. 5 shows a second specific embodiment of a hold-down device according to the present invention.
Figure 6:
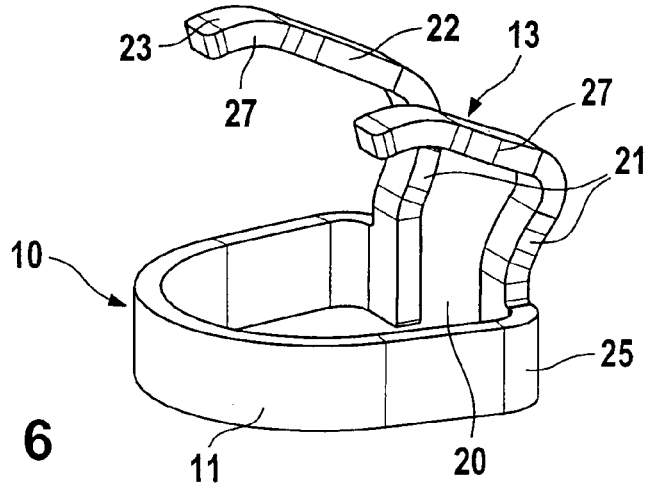
FIG. 6 shows a third specific embodiment of a hold-down device according to the present invention.

In FIGS. 4 to 6, three specific embodiments of hold-down devices 10 according to the present invention are shown, hold-down device 10 shown as an individual component in FIG. 4 corresponding to hold-down devices 10 used in the fuel injection devices in FIGS. 1 to 3. All the specific embodiments are distinguished in that from a flat, partially annular base element 11, at least one bent-away, axially flexible hold-down clip 13 extends out from the plane of base element 11.

Base element 11 has a clip-type construction, and surrounds fuel injection valve 1 in the area of its end 3 at the inflow side. As already described, connecting fitting 8 of fuel injection valve 1 penetrates through open area 20 of base element 11 of hold-down device 10. Base element 11 can be largely circular (FIGS. 4 and 5), or, dependent on the shape of fuel injection valve 1, can have e.g. a pear shape (FIG. 6) or some similar shape in cross-section. In the example shown in FIG. 4, base element 11 has a flat construction, e.g. with a thickness of approximately 1.5 mm, so that a large support surface is present on shoulder 12. In contrast, base elements 11 of hold-down devices 10 in FIGS. 5 and 6 have an edgewise design, for example having a wall thickness of approximately 1.5 mm, which however thus also predetermines the small width of the support surface of the respective base element 11 on shoulder 12.

Hold-down device 10 according to FIG. 4 is a closed clip element, because hold-down clip 13 is connected in endless fashion to base element 11. From base element 11, two webs 21 having enlarged width extend largely in the axial direction, and thus largely perpendicular to the plane of extension of base element 11. These webs 21 make a zigzag transition to the actual axially flexible hold-down clip 13, this hold-down clip 13 being made up of three essential segments. Going out from webs 21, hold-down clip 13 has only a slight axial extension resulting from two oblique segments 22 that have the same shape. Oblique segments 22 go over into slightly curved support segments 23, which finally, in the installed state, make contact with end surface 14 of connecting fitting 6. Between support segments 23, a connecting segment 24 is created that is slightly lowered in relation to support segments 23 and that ensures that the overall hold-down device 10 is closed. The peripheral extension of hold-down clip 13 with its segments 22, 23, and 24 largely corresponds to that of base element 11, but in a different axial plane, resulting from the height of webs 21.

In contrast to the previously described hold-down device 10, hold-down devices 10 according to FIGS. 5 and 6 do not have a connecting segment 24, so that overall an open hold-down device 10 is present. From base element 11, in turn two webs 21 extend largely in the axial direction, and thus largely perpendicular to the plane of extension of base element 11. With respect to their wall thickness, webs 21 run in rotated fashion in relation to base element 11; transition area 25 can be rotated inwardly (FIG. 6) or outwardly (FIG. 5). As shown in FIG. 6, webs 21 can have a bent, e.g. S-shaped, construction. Webs 21 make a zigzag transition to the actual axially flexible hold-down clip 13, this clip being made up of two segments in each case. Hold-down clips 13 have, going out from webs 21, only a slight axial extension, resulting from two uniform segments 22 that have the same shape. Oblique segments 22 go over into slightly curved support segments 23, which finally, in the installed state, make contact with end surface 14 of connecting fitting 6. The two support segments 23 of each hold-down device 10 terminate hold-down clip 13, which in this way has a two-part construction.

The overall hold-down clip 13, with its oblique segments 22 and support segments 23, or connecting segment 24, has in turn a wall thickness of approximately 1.5 mm, while the width of hold-down clip 13, in particular of support segments 23, is greater.

All described hold-down devices 10 are detached from sheets of spring steel or high-grade steel (having a thickness of approximately 1.5 mm), e.g. by stamping, eroding, or laser cutting, and are subsequently brought into the desired shape by bending. All specific embodiments of hold-down device 10 according to the present invention have in common the feature that the surfaces of hold-down device 10 that are loaded by bending tension, in particular oblique segments 22 and support segments 23, run perpendicular to the cut edges 27 that are defined when the blank for hold-down device 10 is detached from the corresponding sheet.

The individual features of hold-down devices 10 shown in FIGS. 4 to 6 can also be combined in various ways not depicted in order to form hold-down devices 10 according to the present invention.

What is claimed is:

1. A hold-down device for a fuel injection device that includes at least one fuel injection valve, a receptacle bore for the fuel injection valve, and a connecting fitting of a fuel distributor line, the hold-down device being clamped between a shoulder of the fuel injection valve and an end surface of the connecting fitting, the hold-down device comprising a partially annular base element from which extends in a bent-away fashion an axially flexible hold-down clip that has at least two webs, two oblique segments, and two support segments.

2. The hold-down device as recited in claim 1, wherein the base element is capable of being placed onto the shoulder of the fuel injection valve.

3. The hold-down device as recited in claim 1, wherein the support segments of the hold-down clip are capable of being placed against the end surface of the connecting fitting.

4. The hold-down device as recited in claim 1, wherein surfaces, loaded by bending tension, of the oblique segments and the support segments run perpendicular to cut edges that result from a detaching of a blank for the hold-down device from a corresponding sheet.

5. The hold-down device as recited in claim 1, wherein the hold down device is realized as a stamped bent part.

6. The hold-down device as recited in claim 1, wherein a sheet used for the hold-down device is made of one of spring steel and high-grade steel.

7. The hold-down device as recited in claim 6, wherein the hold-down device has a wall thickness of approximately 1.5 mm, corresponding to a sheet thickness used.

8. The hold-down device as recited in claim 2, wherein the base element includes a flat partial ring, corresponding to a sheet thickness used.

9. The hold-down device as recited in claim 1, wherein the base element is realized as a partial ring standing edgewise having a wall thickness corresponding to a sheet thickness used.

10. The hold-down device as recited in claim 1, wherein the two support segments are connected to one another directly via a connecting segment, so that the hold-down device forms a closed clip element.

11. The hold-down device as recited in claim 10, wherein a peripheral extension of the hold-down clip corresponds largely to that of the base element.

12. The hold-down device as recited in claim 1, wherein the two support segments terminate a hold-down clip, so that the hold-down device is open.

13. The hold-down device as recited in claim 12, wherein the webs run, with respect to their wall thickness, in rotated fashion in relation to the base element.

14. A fuel injection device for a fuel injection system in an internal combustion engine, comprising:

at least one fuel injection valve;

a receptacle bore for the fuel injection valve;

a connecting fitting of a fuel distributor line; and a hold-down device having a partially annular base element located between a shoulder of the fuel injection valve and an end surface of the connecting fitting, wherein, independent of the hold-down device, on the fuel injection valve there is provided a raised cog that engages in an opening on the connecting fitting.

15. The fuel injection device as recited in claim 14, wherein the cog is provided in an area of transition of an electrical connecting plug to a plastic molding that at least partly surrounds the fuel injection valve.

16. The fuel injection device as recited in claim 15, wherein the opening on the connecting fitting runs in the manner of one of a slot and a groove.

17. The fuel injection device as recited in claim 16, wherein the connecting fitting has on its downstream end a collar that stands out in an annular fashion.

18. The fuel injection device as recited in claim 17, wherein the hold-down device has a partially annular base element from which there extends in a bent-away manner an axially flexible hold-down clip that has at least two webs, two oblique segments, and two support segments.

19. The fuel injection device as recited in claim 15, wherein the hold-down device, seen in a peripheral direction, has an open area through which a connecting plug of the fuel injection valve penetrates.

20. The fuel injection device as recited in claim 19, wherein the hold-down device is mounted on the fuel injection valve in such a way that a hold-down clip is oriented away from a connecting plug of the fuel injection valve.

* * * * *